US009386802B2

(12) United States Patent
Taniguchi

(10) Patent No.: US 9,386,802 B2
(45) **Date of Patent: *Jul. 12, 2016**

(54) COMPOSITE PARTICLE, CIGARETTE FILTER AND PROCESS FOR PRODUCING THE SAME, AND CIGARETTE

(75) Inventor: Hiroki Taniguchi, Himeji (JP)

(73) Assignee: DAICEL CORPORATION, Osaka (JP)

( * ) Notice: Subject to any disclaimer, the term of this patent is extended or adjusted under 35 U.S.C. 154(b) by 1227 days.

This patent is subject to a terminal disclaimer.

(21) Appl. No.: 13/286,263

(22) Filed: Nov. 1, 2011

(65) Prior Publication Data

US 2012/0118309 A1 May 17, 2012

(30) Foreign Application Priority Data

Nov. 11, 2010 (JP) ..... 2010-252457

(51) Int. Cl.
*A24D 3/10* (2006.01)
*A24D 3/14* (2006.01)

(52) U.S. Cl.
CPC ... *A24D 3/10* (2013.01); *A24D 3/14* (2013.01)

(58) Field of Classification Search
CPC ..... A24D 3/14; A24D 3/10
USPC ..... 131/274, 272, 286
See application file for complete search history.

(56) References Cited

U.S. PATENT DOCUMENTS

| | | | | | |
|---|---|---|---|---|---|
| 2,968,306 | A | * | 1/1961 | Touey | 131/334 |
| 3,021,242 | A | * | 2/1962 | Touey | 156/180 |
| 3,349,779 | A | * | 10/1967 | Leonard et al. | 131/334 |
| 3,939,849 | A | * | 2/1976 | Baxter et al. | 131/332 |
| 2004/0237983 | A1 | | 12/2004 | Sasaki et al. | |
| 2005/0000526 | A1 | | 1/2005 | Tarora et al. | |

FOREIGN PATENT DOCUMENTS

| | | | |
|---|---|---|---|
| GB | 1155036 | | 6/1969 |
| JP | 62-226926 | A | 10/1987 |
| JP | 10-215844 | A | 8/1998 |
| JP | 3895327 | B2 | 3/2007 |
| JP | 3905886 | B2 | 4/2007 |
| JP | 2007-319041 | A | 12/2007 |
| JP | 2009-519034 | A | 5/2009 |
| WO | WO 03/056945 | A1 | 7/2003 |
| WO | WO 03/056947 | A1 | 7/2003 |
| WO | WO 2007/069093 | A2 | 6/2007 |
| WO | WO 2009/031248 | A1 | 3/2009 |

OTHER PUBLICATIONS

Extended European Search Report issued Jul. 10, 2014, in European Patent Application No. 11188564.6.

* cited by examiner

*Primary Examiner* — Michael H Wilson
*Assistant Examiner* — Dionne Walls Mayes
(74) *Attorney, Agent, or Firm* — Birch, Stewart, Kolasch & Birch, LLP

(57) ABSTRACT

A composite particle comprises a cellulose acetate and at least one amino compound selected from the group consisting of an amino acid and an aminosulfonic acid.

14 Claims, No Drawings

COMPOSITE PARTICLE, CIGARETTE FILTER AND PROCESS FOR PRODUCING THE SAME, AND CIGARETTE

FIELD OF THE INVENTION

The present invention relates to a composite particle for selectively and efficiently removing an aldehyde compound (in particular, formaldehyde) while maintaining a palatable component such as nicotine or tar, a cigarette filter comprising the composite particle and a process for producing the cigarette filter, as well as a cigarette provided with the cigarette filter.

BACKGROUND OF THE INVENTION

Nowadays, in relation to health effects of smoking, a technique for reducing a harmful component in cigarette smoke is demanded in the cigarette field. Cigarette smoke contains various harmful components. Above all, an aldehyde compound such as formaldehyde not only has a pungent odor but also is noticed as an allergen. However, it is different to remove the aldehyde compound by adsorption with a general-purpose cigarette filter. In order to adsorb the harmful substance, an activated carbon is widely used conventionally. For example, Japanese Application Laid-Open No. 2009-519034 publication (JP-2009-519034A, Patent Document 1) discloses a cigarette filter comprising a mouth end, an activated carbon, and a sodium bicarbonate-treated fiber located between the activated carbon and the mouth end.

However, physical adsorption, typically using an activated carbon, removes not only the harmful substance but also a palatable component in cigarette smoke. In other words, removal of nicotine, tar, and other flavor components changes the taste of cigarette smoke, so that a feeling of satisfaction in smoking is inhibited. Thus, a method for selectively adsorbing an aldehyde compound from mainstream cigarette smoke is desired.

In this respect, as a cigarette which can selectively remove formaldehyde in mainstream smoke, Japanese Patent No. 3895327 publication (JP-3895327B, Patent Document 2) discloses a cigarette comprising a tobacco rod and 48.3 to 146.7 mg of a hydrotalcite compound connected to the tobacco rod. This document also discloses that a paper sheet comprising a particulate hydrotalcite compound having an average particle size of not more than 10 μm is formed to produce a cigarette.

However, in the cigarette, the particulate hydrotalcite compound is easily eliminated and scattered.

On the other hand, as a method for removing a harmful component using an organic component, WO2009/031248 publication (Patent Document 3) discloses a composition comprising at least one amino compound selected from the group consisting of an amino acid and an aminosulfonic acid and a silica gel, and a cigarette filter comprising the composition. This document also discloses that the filter has a triplet structure in which a gap in a divided filter is filled with the composition.

However, since this composition contains the silica gel, the taste of the cigarette is significantly changed. Moreover, use of a plasticizer (e.g., triacetin) in a filter comprising a cellulose acetate tow decreases a capacity to adsorb formaldehyde. Further, since the filter has a triplet structure, damage to the filter involves a risk of getting a scattered particulate porous material in the eyes or the lungs. Moreover, the triplet structure cannot improve the hardness of the filter.

Japanese Patent Application Laid-Open No. 2007-319041 publication (JP-2007-319041A, Patent Document 4) discloses a cigarette filter material in which at least part of a support comprising a filament aggregate is coated with an amino acid or a salt thereof. According to this document, the cigarette filter material is produced by treating a support with a solution at least containing an amino acid or a salt thereof and a polar solvent.

However, since the support for holding an amino acid or a salt thereof in this cigarette filter material is in the form of a tow, the method for producing the cigarette filter is limited.

Japanese Patent Application No. 10-215844 publication (JP-10-215844A, Patent Document 5) discloses a cigarette filter which comprises a tow comprising a filter component, and a water-soluble fibrous resin contained in the tow to bond the filter component. This document also discloses that the filter component is in the form of a particulate or a fiber and that a particulate filter component is used in combination with a fibrous filter component in order to form a tow.

However, this cigarette filter cannot reduce the amount of formaldehyde sufficiently. Further, the document is silent on detailed combination of the particulate filter with the fibrous filter and discloses in Examples that a water-soluble hot-melt resin is added to a cellulose acetate tow.

Japanese Patent No. 3905886 publication (JP-3905886B, Patent Document 6) discloses a cigarette containing a basic amino acid or a salt thereof selected from the group consisting of lysine, histidine, ornithine, citrulline, hydroxyzine, and a salt thereof in an amount of 1 to 27.6 mg/cigarette. According to this document, an aqueous solution of the basic amino acid or the salt thereof is added to a filter.

However, since the cigarette contains water due to the addition of the liquid substance to the filter, the liquid substance is scattered or moved to a tobacco leaf to leave a spot on the leaf during cigarette storage.

[Patent Document 1] JP-2009-519034A (claim 1)

[Patent Document 2] JP-3895327B (Claims and Background Art)

[Patent Document 3] WO2009/031248 (Claims, Paragraph and Examples)

[Patent Document 4] JP-2007-319041A (Claims)

[Patent Document 5] JP-10-215844A (Claim 1, Paragraphs and [0014], and Examples)

[Patent Document 6] JP-3905886B (Claims)

SUMMARY OF THE INVENTION

It is therefore an object of the present invention to provide a particle for selectively and efficiently removing an aldehyde compound (e.g., formaldehyde) while maintaining a palatable component such as nicotine or tar, a cigarette filter comprising the particle, a process for producing the cigarette filter, and a cigarette provided with the cigarette filter.

Another object of the present invention is to provide a particle for addition together with a plasticizer to a cellulose ester tow without deterioration of a capacity to absorb formaldehyde, a cigarette filter comprising the particle, a process for producing the cigarette filter, and a cigarette provided with the cigarette filter.

It is still another object of the present invention to provide a cigarette filter having a high hardness while maintaining a moderate air resistance (pressure drop), a process for producing the cigarette filter, and a cigarette provided with the cigarette filter.

It is a further object of the present invention to provide a cigarette filter in which elimination of a particle can be prevented in spite of a large amount of a particle, a process for producing the cigarette filter, and a cigarette provided with the cigarette filter.

The inventors of the present invention made intensive studies to achieve the above objects and finally found that an aldehyde compound (e.g., formaldehyde) can selectively and efficiently be removed while maintaining a palatable component (e.g., nicotine and tar) by supporting a specific amino compound on a cellulose acetate particle. The present invention was accomplished based on the above findings.

That is, the composite particle of the present invention comprises a cellulose acetate and at least one amino compound selected from the group consisting of an amino acid and an aminosulfonic acid. The cellulose acetate may be a particle form, and the amino compound may be supported on at least a surface of the cellulose acetate particle. The amino compound may comprise an amino acid having a plurality of amino groups. The composite particle of the present invention may have the following particle size: not less than 90% by weight of the composite particle pass through a sieve having an aperture size of 1.7 mm and fail to pass through a sieve having an aperture size of 0.10 mm, and these sieves are in accordance with JIS (Japanese Industrial Standards) Z8801-1 2006. The composite particle of the present invention may have a BET specific surface area of 0.1 to 100 $m^2/g$ and a bulk specific gravity of 0.1 to 0.6. The cellulose acetate may have an acetylation degree of 40 to 62.5%. The ratio of the amino compound may be about 1 to 30 parts by weight relative to 100 parts by weight of the cellulose acetate. The composite particle of the present invention may be substantially free from a chitosan or a salt thereof.

The present invention also includes a cigarette filter comprising the composite particle and a cellulose ester tow. The composite particle may be dispersed in the cellulose ester tow. The composite particle may further contain a plasticizer, and the ratio of the plasticizer may be about 1 to 10 parts by weight relative to 100 parts by weight of the cellulose ester tow, and the composite particle may be fixed to cellulose ester tow with the plasticizer. The plasticizer may comprise an acetin compound. The cellulose ester tow may comprise a cellulose acetate tow, and the cellulose acetate tow may have an average fineness of 10000 to 50000 deniers and a filament of the tow may have an average fineness of 1 to 10 deniers. The ratio of the composite particle may be about 100 to 500 parts by weight relative to 100 parts by weight of the cellulose ester tow. In the cigarette filter of the present invention, the composite particle may be dispersed in the cellulose ester tow, and the filter may have a thickness retention (filter hardness) of not less than 90% under a load of 300 g and have an air resistance of not more than 1500 mmWG at an air flow rate of 17.5 ml/second in a filter rod having a length of 100 mm and a diameter of 8 mm.

The present invention also includes a process for producing a cigarette filter, which comprises a step for combining the composite particle with a cellulose ester tow. In the process of the present invention, the composite particle may be added to an opened cellulose ester tow. Moreover, after addition of the composite particle to a preliminarily opened cellulose ester tow, the cellulose ester tow may be further opened by an airflow.

Further, the present invention includes a cigarette provided with the cigarette filter.

DETAILED DESCRIPTION OF THE INVENTION

[Composite Particle]

The composite particle (or conjugate particle) of the present invention is characterized by an excellent affinity with a cellulose ester tow and an adsorbability to an aldehyde compound (such as formaldehyde) due to a cellulose acetate and a specific amino compound contained therein. With respect to the structure of the composite particle, the composite particle may be a particle comprising a mixture of a cellulose acetate and an amino compound or may have a structure in which a cellulose acetate is supported on a particle comprising an amino compound. In view of an excellent capacity to absorb formaldehyde, it is preferable that the amino compound exist on at least a surface of the particle. As the structure, in which the amino compound exists on at least a surface of the particle, the amino compound is preferably supported on both a surface of an internal pore, having a size of submicron to several tens microns, of the cellulose acetate particle and a surface of the cellulose acetate particle.

(Cellulose Acetate Particle)

The particle size of the cellulose acetate particle (raw material basis) is 1.7 to 0.10 mm using a sieve in accordance with JIS Z8801-1 2006. That is, the cellulose acetate particle in the present invention has the following particle size: not less than 90% by weight of the total particle pass through a sieve having an aperture size of 1.7 mm and fail to pass through a sieve having an aperture size of 0.10 mm (when not less than 90% by weight of the total particle pass through a sieve having an aperture size of 1.7 mm and fail to pass through a sieve having an aperture size of 0.10 mm, the particle size is represented by "1.7 to 0.10 mm"; the same applies hereinafter). Further, the particle size of the cellulose acetate particle in the present invention is preferably 1.0 to 0.18 mm and particularly preferably 1.0 to 0.425 mm. When the particle size is within the range, the filter has a high reducing rate of an aldehyde compound and an improved filter hardness without significantly deteriorating the pressure drop.

The average particle size of the cellulose acetate particle is, for example, about 0.1 to 1.5 mm, preferably about 0.2 to 1 mm, and more preferably about 0.4 to 1 mm.

Examples of the shape of the cellulose acetate particle may include a spherical form, an ellipsoidal form, a polygonal form (e.g., a polyangular-pyramid form, a cubic form, and a rectangular-prism form), a plate-like or scaly (flake) form, a rod-like form, and an amorphous form, and a flake form is widely used. Further, the cellulose acetate particle may be porous (e.g., a porous body having a large number of pores each having a size of submicron to several tens microns).

The specific surface area of the cellulose acetate particle measured by BET method (BET specific surface area) may be selected from the range of about 0.1 to 100 $m^2/g$. In view of a high adsorbability to formaldehyde and an improvement in the amount to be supported of the amino compound, the specific surface area of the cellulose acetate particle may for example be about 1 to 50 $m^2/g$, preferably about 3 to 30 $m^2/g$, and more preferably about 5 to 20 $m^2/g$ (particularly about 8 to 15 $m^2/g$).

The bulk specific gravity of the cellulose acetate particle may for example be about 0.1 to 0.6 $g/cm^3$, preferably about 0.2 to 0.55 $g/cm^3$, and more preferably about 0.3 to 0.5 $g/cm^3$. The cellulose acetate particle having a bulk specific gravity in this range has an excellent handling in filling, and the filling weight of the particle can also be increased.

In view of the capability to support (or load) the amino compound (particularly an amino acid), the adsorbability to formaldehyde, and others, the acetylation degree of the cellulose acetate may for example be selected from the range of about 40 to 62.5% and may be preferably about 45 to 60%, preferably about 50 to 58%, and more preferably 51 to 56% (particularly about 54 to 56%).

According to the present invention, in order to improve the capability to support (or load) the amino compound, it is preferable that the specific surface area of the cellulose acetate particle be adjusted within the above-mentioned range. A particle having a relatively large specific surface area has a small bulk specific gravity, and it is difficult to adjust the bulk specific gravity within the above-mentioned range. In order to prepare a cellulose acetate ester particle having a specific surface area and a bulk specific gravity within the above-mentioned ranges, for example, a raw material having an acetylation degree within the above-mentioned range may be used, an acetic acid concentration or a temperature of an acetic acid aqueous solution as a precipitation solvent in production conditions may be controlled, and an inorganic salt may be contained (or interposed) in the solution.

The polymerization degree (viscosity-average polymerization degree) of the cellulose acetate may usually be, for example, about 10 to 1000 (e.g., about 50 to 1000), preferably about 50 to 900 (e.g., about 100 to 800), and more preferably about 200 to 800.

(Amino Compound)

As the amino compound, at least one member selected from the group consisting of an amino acid and an aminosulfonic acid is used.

The amino acid may be any of a neutral amino acid (e.g., a monoaminocarboxylic acid), an acidic amino acid (e.g., a monoaminodicarboxylic acid), and a basic amino acid (e.g., a diaminocarboxylic acid), or may be a sulfur-containing amino acid.

The amino acid may be any of an α-amino acid, a β-amino acid, and a γ-amino acid (particularly an α-amino acid). Moreover, the amino acid may be any of an optically active substance (e.g., D-form and L-form) and a racemic body.

The amino acid may be in the form of a polymer, and for example, may be a poly- or oligo-amino acid having a low polymerization degree (e.g., a polymerization degree of about 2 to 9, preferably about 2 to 5, and more preferably about 2 to 3).

The amino acid may have a substituent or may be an amino acid derivative in which at least one of carboxyl or amino groups is modified (for example, an amino acid derivative having an amide group, which is derived from carboxyl group of an amino acid).

Concrete examples of the amino acid may include an aliphatic amino acid [for example, an aliphatic monoaminocarboxylic acid such as glycine, alanine, isoleucine, leucine, valine, threonine, serine, asparagine, aminosuccinic acid, cysteine, methionine, glutamine, or glutamic acid (e.g., an amino$C_{2-20}$alkanecarboxylic acid, preferably an amino$C_{2-12}$alkanecarboxylic acid, and more preferably an amino$C_{2-8}$alkanecarboxylic acid), and an aliphatic polyaminocarboxylic acid such as lysine, hydroxylysine, arginine, cysteine, or histidine (e.g., a polyamino$C_{2-20}$alkanecarboxylic acid, preferably a di- to tetramino$C_{2-12}$alkanecarboxylic acid, and more preferably a di- or triamino$C_{2-8}$alkanecarboxylic acid)], an aromatic amino acid (for example, an arylalkanecarboxylic acid such as phenylalanine or tyrosine), a heterocyclic amino acid (for example, tryptophan, histidine, proline, and 4-hydroxyproline), and a poly- or oligopeptide, which is a polymer or oligomer of these amino acids. Moreover, the amino acid may be in the form of a salt, and the salt may include, for example, an alkaline salt [for example, a metal salt (e.g., an alkali metal salt (e.g., a sodium salt such as sodium glutamate or sodium hydrogen glutamate), an ammonium salt, and an amine salt], and an acid salt [for example, a hydrochloride (e.g., arginine hydrochloride), a salt of two or more amino acids (e.g., L-lysine-L-glutamate)]. Further, the amino acid may be a hydrate. These amino acids may be used alone or in combination.

The aminosulfonic acid may include, for example, an aliphatic aminosulfonic acid corresponding to the above-mentioned aminocarboxylic acid (for example, an amino$C_{2-12}$alkanesulfonic acid such as taurine) and an aromatic aminosulfonic acid (for example, an aminobenzenesulfonic acid). The aminosulfonic acid may also be any of an optically active substance and a racemic body, as the same as the amino acid. Moreover, the aminosulfonic acid may be a polymer or may have a substituent. Further, the aminosulfonic acid may also be in the form of a salt, as the same as the amino acid.

Among these amino compounds, in view of the adsorbability to formaldehyde, and others, an amino acid having a plurality of amino groups (for example, a di- to tetramino$C_{2-12}$alkanecarboxylic acid such as lysine, hydroxylysine, arginine, cysteine, or histidine) is preferred. In particular, a basic di- to triamino$C_{2-6}$alkanecarboxylic acid such as lysine or arginine is preferred.

The ratio of the amino compound relative to 100 parts by weight of the cellulose acetate (cellulose acetate particle) may be selected from the range of about 0.1 to 100 parts by weight according to the structure of the composite particle. When the amino compound is supported on the cellulose acetate particle, the ratio of the amino compound relative to 100 parts by weight of the cellulose acetate is, for example, about 1 to 30 parts by weight, preferably about 2 to 25 parts by weight, and more preferably about 3 to 20 parts by weight (particularly about 5 to 15 parts by weight). When the amino compound is supported on the cellulose acetate particle, the form or state of support is not particularly limited to a specific one. In view of the adsorbability to formaldehyde, the amino compound is preferably supported on at least a surface of the cellulose acetate particle. More preferably, the amino compound is supported on both a surface of an internal pore, having a size of submicron to several microns, of the cellulose acetate particle and a surface of the cellulose acetate particle. Particularly preferably, the amino compound is almost uniformly dispersed and supported on both the surface of the cellulose acetate particle and that of the internal pore. Further, the amino compound may be supported on the cellulose acetate particle through a chemical bond (for example, a bond formed by a reaction of a hydroxyl group of the cellulose acetate with a carboxyl group or a sulfonic acid group of the amino compound).

[Process for Producing Composite Particle]

The process for producing the composite particle can be selected according to the structure of the composite particle. When the amino compound is supported on at least a surface of the cellulose acetate particle, the process may comprise a step for adding the cellulose acetate particle to a liquid composition containing the amino compound dissolved or dispersed in a solvent to support the amino compound on the particle.

The solvent is not particularly limited to a specific one as far as the amino compound can be dissolved or dispersed in the solvent. For the amino acid, the preferred solvent may include, for example, an aqueous solvent such as water or a lower alcohol, and water is widely used. The amount of the solvent is not particularly limited to a specific one. The amount of the solvent relative to 100 parts by weight of the amino compound is not less than 10 parts by weight, for example, about 50 to 1000 parts by weight, preferably about 80 to 500 parts by weight, and more preferably about 100 to 300 parts by weight (particularly about 120 to 200 parts by weight). For dissolution or dispersion, the solvent and the amino compound may be heated to not lower than 50° C. (for example, about 60 to 100° C.) and stirred.

In the process comprising a step for adding the cellulose acetate particle to the liquid composition, the cellulose acetate particle may be immersed in the liquid composition to impregnate the cellulose acetate particle with the liquid composition. In view of uniform support of the amino compound, shaking or stirring is preferably conducted after addition of the cellulose acetate particle to the liquid composition. Further, in order to evaporate the solvent and support the amino compound firmly, drying by heating may be conducted. The heating temperature is, for example, about 50 to 200° C., preferably about 60 to 150° C., and more preferably about 80 to 120° C.

[Cigarette Filter]

The composite particle of the present invention is useful for a cigarette filter. It is sufficient that the cigarette filter comprises the composite particle and the cellulose ester tow.

(Cellulose Ester Tow)

The cellulose ester tow is a fiber bundle which is formed with a cellulose ester fiber and has a tow structure or a filter rod structure. Specifically, the cellulose ester tow is a fiber bundle having a structure that a monofilament comprising a cellulose ester is sheaved (a multifilament structure having a substantially infinite continuous length). Concretely, the cellulose ester tow is formed by bundling (or sheaving), for example, about 3,000 to 1,000,000, preferably about 3,000 to 100,000, and more preferably about 5,000 to 100,000 single fibers (monofilaments).

The average fineness (total denier) of the cellulose ester tow is, for example, about 10000 to 50000 deniers, preferably about 20000 to 48000 deniers, and more preferably about 25000 to 45000 deniers (particularly about 30000 to 43000 deniers).

The average fineness of the single fiber (monofilament) constituting the cellulose ester tow is, for example, about 1 to 10 deniers, preferably about 1.2 to 8 deniers, and more preferably 1.5 to 5 deniers (particularly about 1.8 to 3 deniers). The average fiber length of the monofilament may be selected from the range of about 0.1 mm to 5 cm and is, for example, about 0.5 to 30 mm, preferably about 1 to 20 mm, and more preferably about 3 to 15 mm (particularly about 5 to 10 mm).

The shape at cross section in the monofilament is not particularly limited to a specific one, and may for example be any form such as an irregular form (e.g., Y-shaped form, X-shaped form, 1-shaped form, R-shaped form, and H-shaped form) or a shape at cross section of hollow fiber. The shape at cross section is preferably a polygonal irregular form such as Y-shaped form, X-shaped form, I-shaped form, R-shaped form, or H-shaped form. The monofilament is preferably a crimped fiber.

The cellulose ester constituting the cellulose ester fiber is usually a cellulose acetate. However, within a range that the present invention can be achieved, the cellulose ester may contain a small amount of a mixed ester of a cellulose with organic acids each having about 2 to 4 carbon atoms. Such a cellulose ester may include a cellulose acetate propionate, a cellulose acetate butyrate, and others.

Moreover, the substitution degree (average substitution degree) of the cellulose ester (particular, a cellulose acetate) may be, for example, selected from the range of about 1 to 3 (e.g., about 1 to 2.9) and may be preferably about 1.5 to 2.7 and more preferably about 2.2 to 2.6.

The ratio of the composite particle relative to the 100 parts by weight of the cellulose ester tow may be selected from the range of about 10 to 1000 parts by weight and may for example be about 20 to 500 parts by weight (particularly about 30 to 400 parts by weight).

(Plasticizer)

According to the present invention, the plasticizer not only improves the formability (moldability) of the cellulose ester tow but also allows uniform dispersion of the cellulose acetate particle. In addition, the plasticizer also plays a role in fixing the cellulose acetate particle to the cellulose ester tow probably due to attachment of the cellulose acetate particle to the plasticized tow.

As the plasticizer, for example, a compound having a high affinity with an ester group (e.g., acetyl group) of the cellulose ester is preferred. For example, a fatty acid ester of a polyol or a fatty acid ester of a polyol oligomer can be used as the plasticizer. Concrete examples of the plasticizer may include an ester of a polyol with a lower fatty acid (e.g., a $C_{1-4}$alkanecarboxylic acid such as acetic acid) (for example, a $C_{3-6}$alkanetriol-mono- to tri$C_{1-4}$acylate such as monoacetin, diacetin, or triacetin, preferably a glycerin mono- to tri$C_{2-3}$acylate) and an ester of a polyol oligomer with a lower fatty acid (e.g., a di$C_{3-6}$alkanetriol-mono- to tetra$C_{1-4}$acylate such as diglycerin tetraacetate). These plasticizers may be used alone or in combination.

Among these plasticizers, in view of an improved formability of the cellulose ester tow as well as an excellent affinity with the cellulose acetate particle, an acetin compound (e.g., a glycerin di- or triacetate such as diacetin or triacetin), particularly triacetin, is preferred. The plasticizer such as an acetin compound not only plays a conventional role (improvement in formability of the tow) but also allows a uniform dispersion of the cellulose acetate particle in the tow and fixation of the cellulose acetate particle to the cellulose ester tow through the plasticizer.

The ratio of the plasticizer relative to 100 parts by weight of the cellulose ester tow is, for example, about 0.1 to 20 parts by weight, preferably about 1 to 10 parts by weight, and more preferably about 2 to 8 parts by weight (particularly about 5 to 7 parts by weight).

[Structure and Properties of Cigarette Filter]

The structure of the cigarette filter may be a conventional filter structure, for example, a structure (triplet structure) in which a filter comprising a cellulose ester tow is divided into two or more [e.g., divided into two (dual) or three (triple)] and a gap in the divided tow is filled with a composite particle, a structure (dalmatian structure) in which a composite particle is dispersed in a cellulose ester tow, and other structures. Among these structures, in view of inhibition of the particle scattering due to damage, improvement of the filter hardness, and other respects, the dalmatian structure is preferred.

For the dalmatian structure, the dispersion state (or pattern) of the composite particle is not particularly limited to a specific one and may for example be a state in which the concentration of the composite particle in a core of the tow is higher than that in another region. In view of the filter properties and others, a state in which the composite particle is almost uniformly dispersed in the tow is preferred.

The BET specific surface area of the cigarette filter having the dalmatian structure may for example be about 0.5 to 10 $m^2/g$, preferably about 1 to 9.8 $m^2/g$, and more preferably about 2 to 9.5 $m^2/g$ (particularly about 5 to 9.5 $m^2/g$). According to the present invention, since the filter can contain the composite particle in a high concentration, the filter can also have an improved specific surface area and excellent filter properties.

The cigarette filter having the dalmatian structure has a high filter hardness due to the composite particle contained in the tow. The thickness retention of the cigarette filter under a load of 300 g is not less than 88%, for example, not less than 90% (e.g., about 90 to 99.5%), preferably about 91 to 99%, and more preferably about 92 to 98% (particularly about 93 to 97%). According to the present invention, the filter hardness can be adjusted to about 93 to 97% (particularly about 94 to 96%) by adding not less than 100 parts by weight (particularly not less than 200 parts by weight) of the composite particle to 100 parts by weight of the cellulose ester tow.

The cigarette filter having the dalmatian structure has a moderate pressure drop in addition to a high filter hardness as described above. The cigarette filter has an air resistance (pressure drop) of not more 1500 mmWG (water gauge) at an air flow rate of 17.5 ml/second in a filter rod having a length of 100 mm and a diameter of 8 mm. The air resistance may be not more than 1000 mmWG and is, for example, about 250 to 1000 mmWG, preferably about 300 to 900 mmWG, and more preferably about 350 to 800 mmWG (particularly about 380 to 600 mmWG). According to the present invention, a filter having a moderate pressure drop while inhibiting an extreme increase in air resistance can be prepared, even when a large amount of the composite particle is added to the tow to improve the filter hardness.

The cigarette filter of the present invention has an excellent selective removal efficiency of formaldehyde. For example, the reducing rate of formaldehyde may be selected from the range of not more than 90% and is, for example, about 3 to 80%, preferably about 5 to 70%, and more preferably about 10 to 65% (particularly about 20 to 60%).

On the other hand, each of the reducing rate of nicotine and that of tar in the cigarette filter of the present invention is not more than 40%, preferably about 0 to 35%, and more preferably about 1 to 25% (particularly about 2 to 15%).

These reducing rates are relative values to those in a cigarette filter free from the composite particle, and can be measured according to the methods described in the after-mentioned Examples.

The cigarette filter may contain a conventional additive, for example, other adsorbents (e.g., an organic adsorbent such as a polyphenol compound, a higher fatty acid ester, a chitosan or a salt thereof, or a perfume, and an inorganic adsorbent such as activated carbon), an inorganic particle (e.g., kaolin, talc, zeolite, diatomaceous earth, silica gel, quartz, calcium carbonate, barium sulfate, titanium oxide, alumina, and zirconia), a humectant (e.g., an alkanediol such as ethylene glycol or propylene glycol, a polyalkylene glycol such as diethylene glycol or triethylene glycol, and an alkanetriol such as glycerin or trimethylolpropane), a staple (or short) fiber (e.g., a cellulose ester fiber and a cellulose fiber), an organic particle (e.g., a synthetic resin particle and a small piece of wood), a protein (e.g., gelatin and casein), a heat stabilizer (e.g., a salt of an alkali or alkaline earth metal), a coloring agent, a whitening agent, an oil, a retention aid for paper, a sizing agent, and a natural polymer or a derivative thereof (e.g., a cellulose powder). These conventional additives may be used alone or in combination. These additives may be contained in a ratio of, for example, not more than 10 parts by weight and preferably not more than 5 parts by weight (e.g., about 0.01 to 5 parts by weight) relative to 100 parts by weight of the cellulose ester tow.

In order to further improve the removal of the harmful component, the cigarette filter of the present invention may contain a conventional adsorbent, a chitosan or a salt thereof, a perfume, and others. However, since the cigarette filter contains the composite particle having the amino compound supported thereon and can efficiently remove the harmful component such as an aldehyde compound, the cigarette filter may be substantially free from an adsorption substance such as a chitosan or a salt thereof.

The cigarette of the present invention is provided with (or comprises) the cigarette filter having such properties. The site to be disposed of the cigarette filter is not particularly limited to a specific one. In a cigarette shaped in the form of a rod by a wrapper, the cigarette filter is often disposed in the mouthpieth or between the mouthpieth and paper-wrapped cigarette. Incidentally, the periphery of the cross section of the cigarette corresponds to that of the cross section of the filter in many cases, and may usually be about 15 to 30 mm and preferably about 17 to 27 mm.

[Process for Producing Cigarette Filter]

The cigarette filter of the present invention can be obtained using a cellulose ester tow obtained according to a conventional spinning method (dry spinning, melt spinning, or wet spinning) and a composite particle (and optionally a plasticizer such as an acetin compound) by a conventional method according to the filter structure.

Specifically, for a cigarette filter having a triplet structure, using an existing apparatus for producing a cigarette filter, the cigarette filter may be shaped by opening a bale of a cellulose ester tow, adding a plasticizer to the opened tow with an apparatus for adding a plasticizer, bundling (or sheaving) the tow at a given diameter, wrapping the resulting bundled tow in paper with a filter rod maker to give a filter plug (bundle), and filling a space of the filter plug with a composite particle.

On the other hand, for a cigarette filter having a dalmatian structure, using an existing apparatus for producing a cigarette filter, the cigarette filter may be shaped by opening a bale of a cellulose ester tow, adding a plasticizer to the opened tow with an apparatus for adding a plasticizer, further adding a cellulose acetate particle to the tow with an apparatus for adding an activated carbon (charcoal-adding system or mechanism), bundling (or sheaving) the tow at a given diameter, and wrapping the resulting bundled tow in paper for fixation with a filter rod maker to give a filter plug (bundle).

According to the present invention, since the composite particle comprises the cellulose acetate and the specific amino compound, an aldehyde compound (such as formaldehyde) can selectively and efficiently be removed while maintaining a palatable component such as nicotine or tar. Moreover, the composite particle can be added together with a plasticizer to the cellulose ester tow without deteriorating the adsorbability to formaldehyde. Further, the cigarette filter containing the composite particle has a high hardness while maintaining a moderate air resistance (pressure drop).

The cigarette filter of the present invention is available as a cigarette filter for a paper-wrapped cigarette, and the like.

EXAMPLES

The following examples are intended to describe this invention in further detail and should by no means be interpreted as defining the scope of the invention. In the following Examples and Comparative Examples, cigarette samples were made in accordance with the following methods, and properties (a particle size, an air resistance, a removal amount of formaldehyde, and a filter hardness) were measured in accordance with the following methods.

[Particle Size]

Using sieves in accordance with JIS Z 8801-12006, an aperture size that not less than 90% by weight of the particle passed through was regarded as an upper limit of the particle size, and an aperture size that not less than 90% by weight of the particle failed to pass through was regarded as a lower limit of the particle size.

[Air Resistance]

Concerning filter rods each having a length of 100 mm and cigarette samples each having a filter with a length of 20 mm attached thereto, obtained in Examples and Comparative Examples, the air resistance was determined as a pressure drop (mmWG) measured by an automatic air-resistance-measuring apparatus ("QTM-6" manufactured by CERULEAN, the U.K.) at an air flow rate of 17.5 ml/second. Since the cigarette samples could not be measured automatically by the apparatus, each of the samples was measured manually.

[Reducing Rate of Formaldehyde]

The smoking was conduced by using a cigarette sample with the use of a piston-type automatic smoking instrument having constant volume (manufactured by Heinr. Borgwaldt GmbH, "RM20/CS") at a flow rate of 17.5 ml/second for a smoking period of 2 second/time with a smoking frequency of once per minute. Formaldehyde in smoke passed through the cigarette sample was collected in a DNPH (dinitrophenylhydrazine) solution to derivatize the formaldehyde with DNPH. The ultraviolet ray (UV) absorbance of the derivatized formaldehyde was measured by using a gas chromatograph (manufactured by Hitachi, Ltd., "G-3000").

The reducing (or removing) rate of formaldehyde was calculated in accordance with the following formula. In the formula, Tf represents an amount of formaldehyde collected in the reference cigarette, and Cf represents an amount of formaldehyde collected in each sample of Examples and Comparative Examples. The larger the reducing rate of formaldehyde is, the more excellent the adsorbability to the formaldehyde is.

$$\text{Reducing rate of formaldehyde (\%)}=100\times(1-C_f/T_f)$$

Filter Hardness (Thickness Retention)

Concerning the filter rods, each having a length of 100 mm, produced in each of Examples and Comparative Examples, the filter hardness was measured by a hardness testing machine ("QTM7" manufactured by Filtrona). Specifically, the filter hardness (%) was calculated by the following formula. In the formula, when a load of 300 g is vertically applied to a side face of a filter rod by laying the filter rod down on a horizontal plane and applying a pressure to the filter rod through a plate parallel to the horizontal place from above, "d" represents a diameter of the filter rod in the load direction after the deformation by the load, and "$d_0$" represents a diameter of the filter rod before the deformation. That is, when the filter rod does not change the shape at all, the hardness is 100%. The closer the hardness gets to 100%, the harder the filter rod is.

$$\text{Filter hardness (\%)}=d/d_0\times100$$

Example 1

Production of Composite Particle

A cellulose acetate ("L-40" manufactured by Daicel Chemical Industries, Ltd., acetylation degree of 55.6%) was classified by sieving to give a cellulose acetate particle A having a particle size of "1.0 to 0.425 mm". The cellulose acetate particle A had a bulk specific gravity of 0.40 and a BET specific surface area of 10.8 $m^2$/g. On the other hand, 16 parts by weight of L(+)-arginine (Wako Pure Chemical Industries, Ltd. special grade reagent) and 25 parts by weight of water were put into an airtight container, heated to 80° C., and stirred for dissolution to prepare an aqueous solution of arginine. To this aqueous solution were added 100 parts by weight of the cellulose acetate particle A. The airtight container was sealed and shaken until the aqueous solution of arginine was absorbed to the cellulose acetate particle A and uniformalized. Thereafter, the airtight container was unsealed and dried at 105° C. by a hot air dryer to give a composite particle Arg-A of arginine and the cellulose acetate. The composite particle Arg-A contains about 16 parts by weight of arginine.

(Production of Cigarette Sample Having Triplet Structure (Gap-Filling Method))

In a filter body (25 mm) of a cellulose diacetate crimped fiber tow of a commercially available cigarette ["Peace Light Box" (Registered Trademark No. 2122839) manufactured by Japan Tobacco, Inc.], part of the filter body (14 mm from the end) was cut with a razor. The obtained longer piece (that is, a piece containing a tobacco leaf-filled part) was inserted to a glass tube (a length of 20 mm and an internal diameter of 8 mm) in order that the remaining filter (11 mm) was promptly covered with the glass tube (up to the end of the tobacco leaf-filled part). Then, the cigarette and glass tube were united by a sealing tape. The empty space (a length of 9 mm) of the glass tube to which the filter was inserted was filled with the resulting composite particle (100 mg). Then, the cut shorter piece (that is, the filter part having a length of 14 mm) was used to plug an opened end of the glass tube. Thereafter, the connect part of the glass tube to the filter was also sealed up by wrapping a sealing tape around the connect part to give a cigarette sample for smoking test. Accordingly, the length of the filter comprising the cellulose diacetate crimped fiber tow was 25 mm. Moreover, 100 mg of the composite particle per cigarette was filled in the extended part (9 mm) between the filters. In addition, a reference cigarette was obtained in the same manner as in this method except that the composite particle was not filled. Concerning each of these cigarette samples, the air resistance was measured, and the reducing rate of formaldehyde was evaluated.

(Production of Cigarette Sample Having Dalmatian Structure)

Using a filter rod maker for production of charcoal cigarette filter ("KDF2/AC1/AF1" manufactured by Hauni, Germany), a cellulose acetate fiber tow (total denier: 37000) comprising a filament (3.0 deniers) having a Y-shaped cross section was opened to a width of about 25 cm, the opened tow was uniformly sprayed with the resulting composite particle using a charcoal addition mechanism in a ratio of 100 parts by weight of the composite particle relative to 100 parts by weight of the tow during rolling up the filter, fed to a paper-wrapping apparatus, and rolled up with a web paper at a roll-up rate of 400 m/minute to give a filter rod. The resulting filter rod was cut to a length of 100 mm with a cutter. The resulting filter rod was further cut to a length of 20 mm to produce a filter sample.

In a filter body (25 mm) of a cellulose diacetate crimped fiber tow of a commercially available cigarette ("Peace Light Box"), part of the filter body (20 mm from the end) was cut with a razor. The obtained longer piece (that is, a piece containing a tobacco leaf-filled part), was inserted to a glass tube (a length of 20 mm and an internal diameter of 8 mm) in order that the remaining filter (5 mm) was promptly covered with the glass tube (up to the end of the tobacco leaf-filled part). Then, the cigarette and glass tube were united by a sealing tape. Further, the above-mentioned filter sample (a length of 20 mm) was inserted to the empty space (a length of 15 mm) of the glass tube to which the filter was inserted, where the insertion length of the filter sample corresponded to the empty space (15 mm) of the glass tube. The glass tube and the filter sample were united by a sealing tape to produce a cigarette sample. In addition, a reference sample was obtained in the same manner in this method except that the cut filter part (20 mm) was reattached instead of the filter sample. Concerning each of these cigarette samples, the air resistance was measured, and the reducing rate of formaldehyde was evaluated.

Example 2

In the same manner as in Example 1 except for using glycine (Wako Pure Chemical Industries, Ltd. special grade reagent) as an amino acid, a composite particle Gly-A of glycine and the cellulose acetate was obtained. Using the resulting composite particle, a cigarette sample having a triplet structure and that having a dalmatian structure were produced in the same manner as in Example 1, and the properties thereof were evaluated.

Example 3

In the same manner as in Example 1 except for using sodium hydrogen L(+)-glutamate monohydrate (Wako Pure Chemical Industries, Ltd. special grade reagent) as an amino acid, a composite particle NaGlu-A of sodium hydrogen L(+)-glutamate monohydrate and the cellulose acetate was obtained. Using the resulting composite particle, a cigarette sample having a triplet structure and that having a dalmatian structure were produced in the same manner as in Example 1, and the properties thereof were evaluated.

Example 4

A cellulose acetate ("LM-80" manufactured by Daicel Chemical Industries, Ltd., acetylation degree of 52.0%) was classified by sieving to give a cellulose acetate particle B having a particle size of "1.0 to 0.425 mm". The cellulose acetate particle B had a bulk specific gravity of 0.29 and a BET specific surface area of 2.5 $m^2/g$. In the same manner as in Example 1 except for using the cellulose acetate particle B instead of the cellulose acetate particle A, a composite particle Arg-B of arginine and the cellulose acetate was obtained. Using the resulting composite particle, a cigarette sample having a triplet structure and that having a dalmatian structure were produced in the same manner as in Example 1, and the properties thereof were evaluated.

Example 5

In the same manner as in Example 4 except for using glycine (Wako Pure Chemical Industries, Ltd. special grade reagent) as an amino acid, a composite particle Gly-B of glycine and the cellulose acetate was obtained. Using the resulting composite particle, a cigarette sample having a triplet structure and that having a dalmatian structure were produced in the same manner as in Example 1, and the properties thereof were evaluated.

Example 6

In the same manner as in Example 4 except for using sodium hydrogen L(+)-glutamate monohydrate (Wako Pure Chemical Industries, Ltd. special grade reagent) as an amino acid, a composite particle NaGlu-B of sodium hydrogen L(+)-glutamate monohydrate and the cellulose acetate was obtained. Using the resulting composite particle, a cigarette sample having a triplet structure and that having a dalmatian structure were produced in the same manner as in Example 1, and the properties thereof were evaluated.

Example 7

Production of Cigarette Sample Having Dalmatian Structure

Using a filter rod maker for production of charcoal cigarette filter ("KDF2/AC1/AF1" manufactured by Hauni, Germany), a cellulose acetate fiber tow (total denier: 40000) comprising a filament (2.2 deniers) having a Y-shaped cross section was opened to a width of about 20 cm, the opened tow was uniformly sprayed with triacetin in a ratio of 6 parts by weight of triacetin relative to 100 parts by weight of the tow, then uniformly sprayed with the composite particle Arg-A obtained in Example 1 using a charcoal addition mechanism in a ratio of 100 parts by weight of the composite particle relative to 100 parts by weight of the tow during rolling up the filter, fed to a paper-wrapping apparatus, and rolled up with a web paper at a roll-up rate of 400 m/minute to give a filter rod. The resulting filter rod was cut to a length of 100 mm with a cutter. The resulting filter rod was further cut to a length of 20 mm to produce a filter sample. Using the filter sample, a cigarette sample was produced in the same manner as in Example 1. Concerning the cigarette sample, the air resistance was measured, and the reducing rate of formaldehyde was evaluated.

Comparative Example 1

A cigarette sample having a dalmatian structure was produced in the same manner as in Example 7 except that the composite particle was not added. Concerning the cigarette sample, the air resistance was measured, and the reducing rate of formaldehyde was evaluated.

Comparative Example 2

In accordance with a method described in Example 17 of WO2009/031248 (Patent Document 3), a composite particle 30ARG1000 of arginine and a silica gel was prepared. Specifically, 5 g of a silica gel (manufactured by Fuji Silysia Chemical Ltd., "granular product equivalent of MB1000", particle size: 14 to 32 mesh) was placed in a glass container. To the glass container was added 5.3 g of a 3% by weight solution of L-arginine (L-arginine special grade reagent commercially available from Wako Pure Chemical Industries, Ltd.) in water. The mixture was stirred with a glass rod for about 5 minutes until the aqueous solution was absorbed to the silica gel and apparently uniformized to give a particle of the apparently uniform water-containing mixture composition. The resulting water-containing mixture composition was dried at a room temperature by a vacuum dryer until there was no change in the weight, and then left to stand in an air-conditioned room at a temperature of 22° C. and a humidity of 60% until there was no change in the weight to give a composite particle 30ARG1000. In the same manner as in Example 7 except for using the resulting composite particle 30ARG1000, a cigarette sample having a dalmatian structure was produced. Concerning the cigarette sample, the air resistance was measured, and the reducing rate of formaldehyde was evaluated.

Table 1 shows evaluation results of the filters obtained in Examples and Comparative Examples.

TABLE 1

| | Ratios of composite particle and plasticizer relative to 100 parts by weight of tow (parts by weight) | Triplet structure | | Dalmatian structure | | | |
|---|---|---|---|---|---|---|---|
| | | | | Air resistance (mmWG) | | | |
| | | Air resistance (mmWG) | Reducing rate of formaldehyde (%) | Filter rod (100 mm) | Cigarette (20 mm) | Reducing rate of formaldehyde (%) | Filter hardness (%) |
| Example 1 | Arg-A:100 | 178 | 63 | 428 | 172 | 46 | — |
| Example 2 | Gly-A:100 | 172 | 45 | 420 | 170 | 32 | — |
| Example 3 | NaGlu-A:100 | 175 | 26 | 400 | 168 | 20 | — |
| Example 4 | Arg-B:100 | 170 | 34 | 395 | 166 | 28 | — |
| Example 5 | Gly-B:100 | 168 | 24 | 380 | 160 | 17 | — |
| Example 6 | NaGlu-B:100 | 174 | 14 | 392 | 165 | 10 | — |
| Example 7 | Arg-A:100, plasticizer:6 | — | — | 440 | 178 | 44 | 93.7 |
| Comparative Example 1 | plasticizer:6 | — | — | 415 | 170 | 1 | 86.2 |
| Comparative Example 2 | 30ARG1000:100, plasticizer:6 | — | — | 458 | 181 | 25 | 91.5 |

As apparent from the results shown in Table 1, the filters of Examples have a high hardness and a high reducing rate of formaldehyde while maintaining a moderate air resistance. In contrast, the filter of Comparative Example 1, which contains no composite particle, has a low reducing rate of formaldehyde. Further, for the filter of Comparative Example 2, which contains the composite particle of arginine and the silica gel, the silica gel is influenced by triacetin, and formaldehyde cannot be decreased sufficiently. Furthermore, since triacetin does not plasticize a silica gel, falling off of the composite particle from the filter was significantly observed.

What is claimed is:

1. A cigarette filter comprising a composite particle and a cellulose ester tow, wherein the filter has a thickness retention of not less than 90% under a load of 300 g and has an air resistance of not more than 1500 mm WG at an air flow rate of 17.5 ml/second in a filter rod having a length of 100 mm and a diameter of 8 mm, wherein the composite particle comprises a cellulose acetate and at least one amino compound selected from the group consisting of an amino acid and an aminosulfonic acid, and the composite particle has a particle size whereby not less than 90% by weight of the composite particle pass through a sieve having an aperture size of 1.7 mm and fails to pass through a sieve having an aperture size of 0.10 mm, wherein the sieves are in accordance with JIS Z8801-1 2006, and wherein the cellulose acetate is a particle form, and the amino compound is supported on at least a surface of the cellulose acetate particle.

2. The cigarette filter according to claim 1, wherein the composite particle is dispersed in the cellulose ester tow.

3. The cigarette filter according to claim 1, which further contains a plasticizer, wherein the ratio of the plasticizer is 1 to 10 parts by weight relative to 100 parts by weight of the cellulose ester tow, and the composite particle is fixed to the cellulose ester tow with the plasticizer.

4. The cigarette filter according to claim 3, wherein the plasticizer comprises an acetin compound.

5. The cigarette filter according to claim 1, wherein the cellulose ester tow comprises a cellulose acetate tow, and the cellulose acetate tow has an average fineness of 10000 to 50000 deniers and a filament of the tow has an average fineness of 1 to 10 deniers.

6. The cigarette filter according to claim 1, wherein the ratio of the composite particle is 100 to 500 parts by weight relative to 100 parts by weight of the cellulose ester tow.

7. The cigarette filter according to claim 1, wherein the composite particle is added to an opened cellulose ester tow.

8. The cigarette filter according to claim 7, wherein the composite particle is added to a preliminarily opened cellulose ester tow, and then the cellulose ester tow is further opened by airflow.

9. A cigarette provided with the cigarette filter recited in claim 1.

10. The cigarette filter according to claim 1, wherein the amino compound comprises an amino acid having a plurality of amino groups.

11. The cigarette filter according to claim 1, wherein the composite particle has a BET specific surface area of 0.1 to 100 $m^2/g$ and a bulk specific gravity of 0.1 to 0.6.

12. The cigarette filter according to claim 1, wherein the cellulose acetate has an acetylation degree of 40 to 62.5%.

13. The cigarette filter according to claim 1, wherein the ratio of the amino compound is 1 to 30 parts by weight relative to 100 parts by weight of the cellulose acetate.

14. The cigarette filter according to claim 1, wherein the composite particle is substantially free from a chitosan or a salt thereof.

* * * * *